US006764340B2

(12) United States Patent
Toda

(10) Patent No.: US 6,764,340 B2
(45) Date of Patent: Jul. 20, 2004

(54) SHIELDED CONNECTOR ASSEMBLY

(75) Inventor: Shinsaku Toda, Kanagawa (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/369,278

(22) Filed: Feb. 17, 2003

(65) Prior Publication Data

US 2003/0157837 A1 Aug. 21, 2003

(30) Foreign Application Priority Data

Feb. 18, 2002 (JP) ..... 2002-039540

(51) Int. Cl.[7] ..... H01R 13/648
(52) U.S. Cl. ..... 439/607
(58) Field of Search ..... 439/607–610

(56) References Cited

U.S. PATENT DOCUMENTS 6,053,773 A * 4/2000 Wu ..... 439/609
6,077,127 A 6/2000 Wu
6,227,880 B1 * 5/2001 Zhu et al. ..... 439/92
6,273,757 B1 * 8/2001 David et al. ..... 439/607
6,319,061 B1 * 11/2001 Chen et al. ..... 439/607
6,503,102 B1 * 1/2003 Zhang et al. ..... 439/607

FOREIGN PATENT DOCUMENTS

JP 2000-340332 12/2000

* cited by examiner

*Primary Examiner*—Ross Gushi

(57) ABSTRACT

A shielded connector assembly having a small number of parts and high resistance against prying forces exerted by another connector. When shield shells are mounted to shielded connector portions of an integrally formed insulative housing, side walls of the shield shells are positioned within paths of the housing. Latch tongue pieces of the side walls engage shoulders of engagement recesses of the housing, and latch tongue pieces of upper walls engage stopper portions. The shield shells are prevented from being pulled out from the housing. The side walls are supported so that movement in the direction perpendicular to partition walls is prevented due to its position between support surfaces of the partition walls and a base portion of the housing.

20 Claims, 7 Drawing Sheets

SHIELDED CONNECTOR ASSEMBLY

CROSS REFERENCE TO RELATED APPLICATIONS

This application claims the benefit of Japanese Patent Application No. 2002-39540 filed Feb. 18, 2002.

BACKGROUND OF THE INVENTION

The present invention relates generally to an electrical connector assembly, and, more particularly, to a shielded connector assembly having a shield shell for shutting out electromagnetism.

Electrical connections are commonly provided with shielding to shut out electromagnetic interference (EMI). Electromagnetic shielding protects the signal paths of electrical connectors of computers, for example, from the effects caused by external electromagnetic waves. Alternatively, shielding is provided to prevent electromagnetic waves generated by the connector portions from exerting influence on surrounding components and signal paths. Various types of connectors use metallic shells to afford EMI shielding. It is common for the shells to be mounted in a manner that covers an insulative housing that has electrical contacts therein.

Examples of shielded connector assemblies having metallic shells, are disclosed in Taiwanese Utility Model Application No. 389387 and U.S. Pat. No. 6,077,127. These prior shielded connector assemblies include two connector portions, a first shell that surrounds the entirety of the two connector portions, and a second shell arranged between the connector portions. The latter shielded connector assembly of the '127 patent comprises two independent shielded connectors, each covered by a shield shell. The two independent shielded connectors are structured as a single shielded connector assembly by being connected by a separate housing.

In the shielded connector assembly of the '387 Taiwan application, although there is only one housing, the first shell that covers the housing is only mounted to the housing by engagement of a latch. Therefore, it is structurally weak when exposed to prying forces. That is, during the engagement operation with another connector, or in a state of engagement therewith, if a prying force is applied by the connector, the shell is easily deformed. As a result, the excessive prying force is imparted to the housing, and there is a risk of damage to the housing or to the shell.

The shielded connector assembly of the '127 patent is more resistant to prying forces. However, the connection of the '127 patent uses a large number of parts, for example, it uses three pieces to form the housing.

BRIEF DESCRIPTION OF THE INVENTION

In accordance with a preferred embodiment of the invention, a shielded connector assembly having a small number of parts and a high resistance against prying forces is provided.

In accordance with an exemplary embodiment of the invention, the assembly comprises an integrally formed insulative housing comprising a plurality of shielded connector portions spaced from one another at predetermined intervals and a plurality of shells for shielding the connector portions independently of each other. Contacts are to be arranged at the shielded connector portions, and the insulative housing is provided with wall portions positioned between adjacent shells for supporting the shells on both sides thereof.

In accordance with another exemplary embodiment of the invention, a shielded connector assembly is provided. The assembly comprises an integrally formed insulative housing comprising a plurality of shielded connector portions spaced from one another at predetermined intervals and divided by partition walls. A plurality of shield shells each cover a respective one of the shielded connector portions, and at least one of the shield shells is supported on opposite sides by the partition walls and is latched to the partition side walls. Contacts are arranged at the shielded connector portions and are located within the shield shells.

In accordance with another exemplary embodiment of the invention, a different shielded connector assembly is provided. The assembly comprises an integrally formed insulative housing comprising a plurality of shielded connector portions spaced from one another at predetermined intervals and divided by partition walls. A plurality of shield shells each cover a respective one of the shielded connector portions. At least one of the shield shells is supported on opposite sides by the partition walls and is latched to the partition side walls along at least one side wall and an upper wall. Each of the shield shells comprise securing legs for securing the shielded connector assembly to a circuit board on which it is mounted. Contacts are arranged at the shielded connector portions and are located within the shield shells.

DETAILED DESCRIPTION OF THE INVENTION

Figure 1:
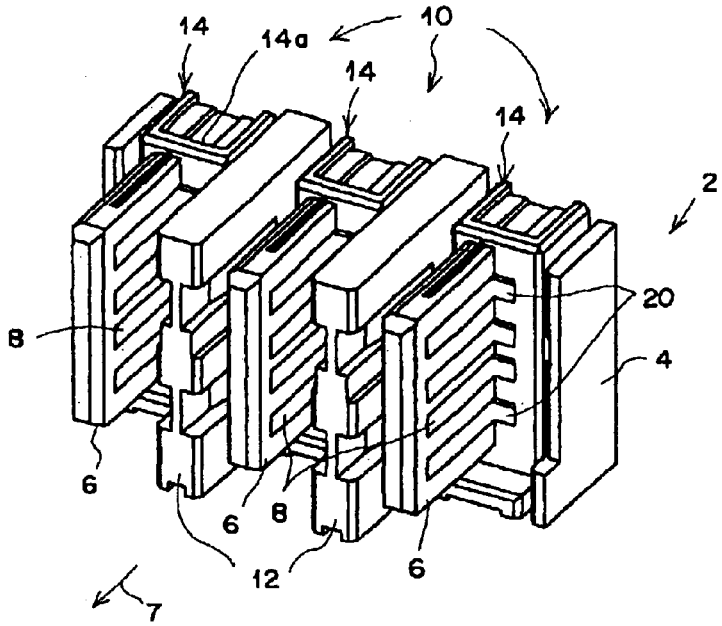
FIG. 1 is a perspective view of an exemplary insulative housing utilized in a shielded connector assembly formed in accordance with an embodiment of the present invention.
Figure 2:
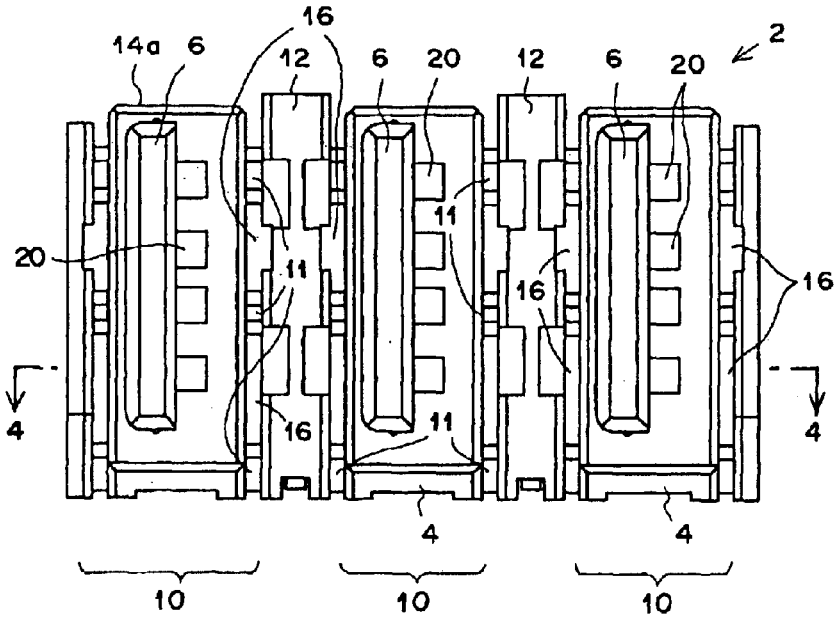
FIG. 2 is a front view of the insulative housing of FIG. 1.

FIGS. 1–4 illustrate an exemplary insulative housing 2 fabricated as a single member and formed from a resin material. The housing 2 includes a substantially rectangular base portion 4 and three engagement ribs 6 that extend at predetermined intervals from the base portion 4 in the forward direction, that is, toward another connector (not shown), indicated by an arrow 7. The engagement ribs 6 extend vertically so as to be substantially perpendicular with respect to the lengthwise direction of the housing 2. A plurality of contact housing grooves 8 that extend in the engagement direction are formed at predetermined intervals along the vertical direction of the ribs 6. Shield shells 22 (shown in FIG. 5 through FIG. 9 and described below) are mounted at the portions of the base portion 4 corresponding to each of the engagement ribs 6 to construct three shielded connector portions 10. However, contacts 52 (shown in FIG. 13) are omitted from FIG. 1 through FIG. 4. In addition, openings 20 (shown in FIG. 1, FIG. 2, and FIG. 4) that communicate with the contact housing grooves 8 are formed in the base portion 4 of the housing 2.

Partition walls 12 extend parallel to the engagement ribs 6 and protrude from the base portion 4. The shield shells 22 are supported by the partition walls 12. That is, the shield shells 22 are supported by the partition walls 12 so that they do not move when the other connector is engaged, even if the other connector applies a prying force, as described in some detail below. FIGS. 5–9 illustrate a structure provided for mounting the shield shells 22 onto the housing 2.

Figure 3:
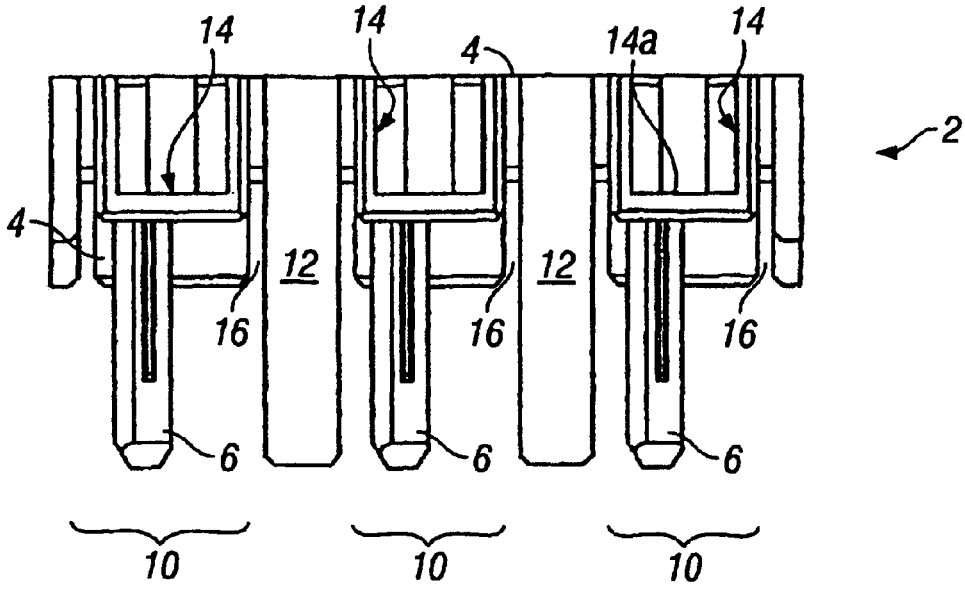
FIG. 3 is a top plan view of the insulative housing of FIG. 1.

As shown in FIG. 1 and FIG. 3, U-shaped ribs 14 are formed on the upper surfaces of each of the shielded connector portions 10 on the base portion 4. The central portion of the ribs 14 are positioned at the front end of the base portion 4, and serve as stopper portions 14*a* to prevent removal of the shield shells 22.

Figure 4:
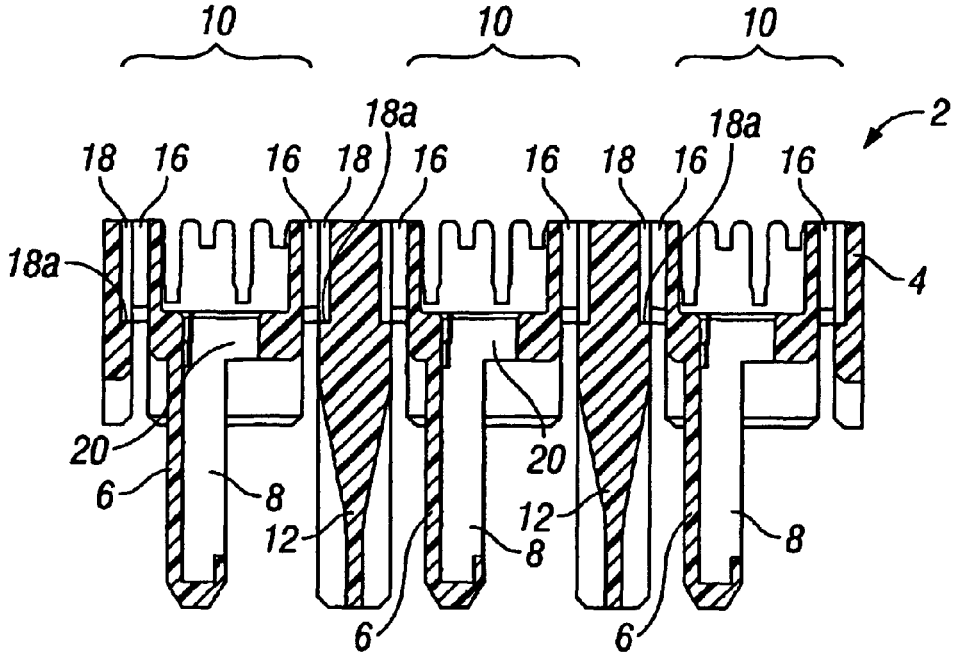
FIG. 4 is a sectional view of the insulative housing taken along the line 4—4 of FIG. 2.
Figure 5:
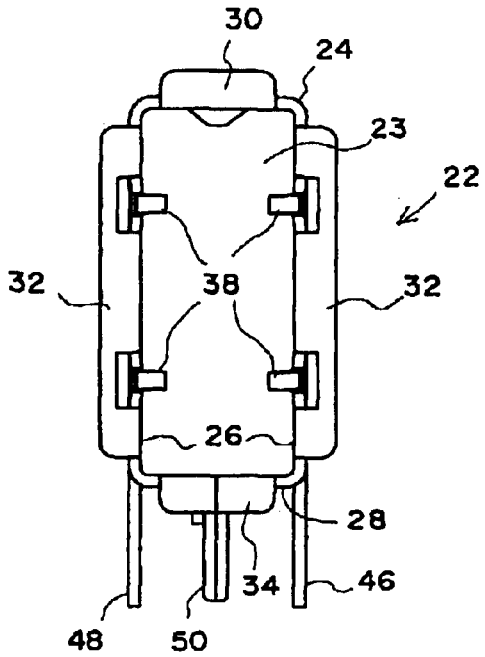
FIG. 5 is a front view of an exemplary shield shell utilized in a shielded connector assembly formed in accordance with an embodiment of the present invention.
Figure 6:
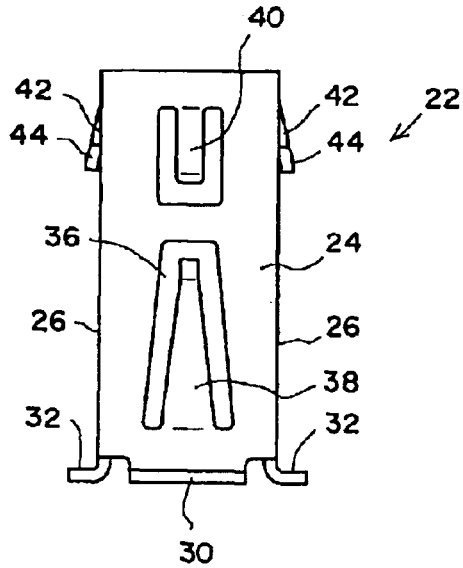
FIG. 6 is a top plan view of the shield shell of FIG. 5.
Figure 7:
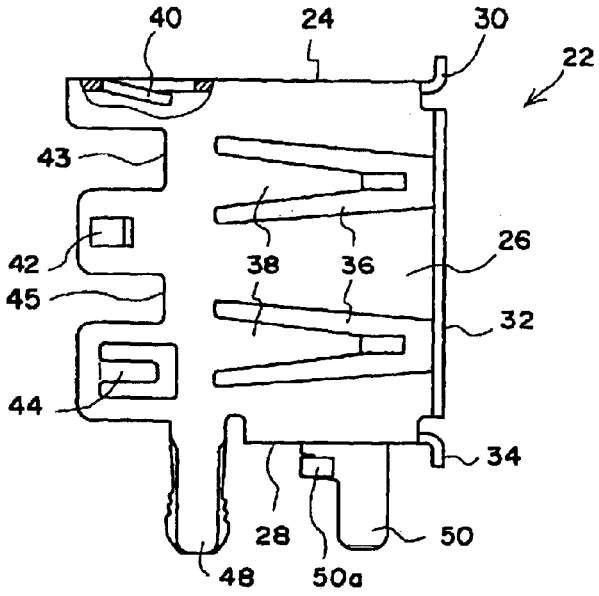
FIG. 7 is a left side view of the shield shell of FIG. 5.
Figure 8:
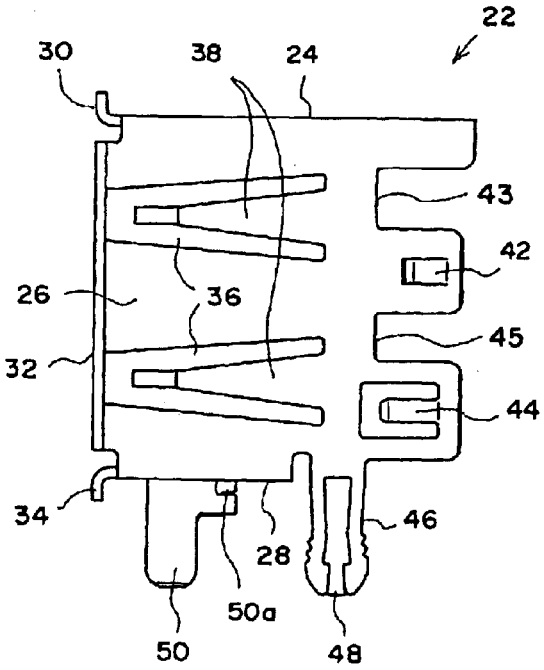
FIG. 8 is a right side view of the shield shell of FIG. 5.
Figure 9:
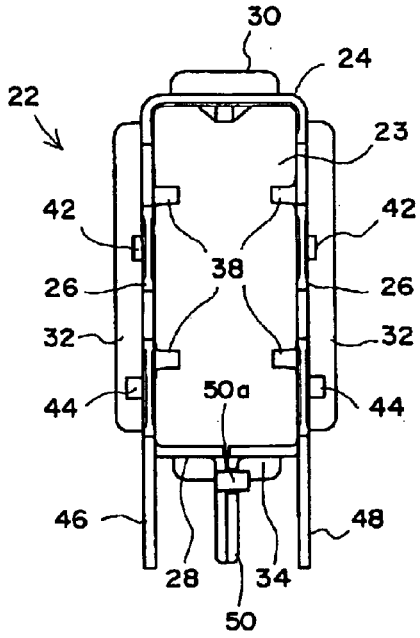
FIG. 9 is a rear view of the shield shell of FIG. 5.
Figure 10:
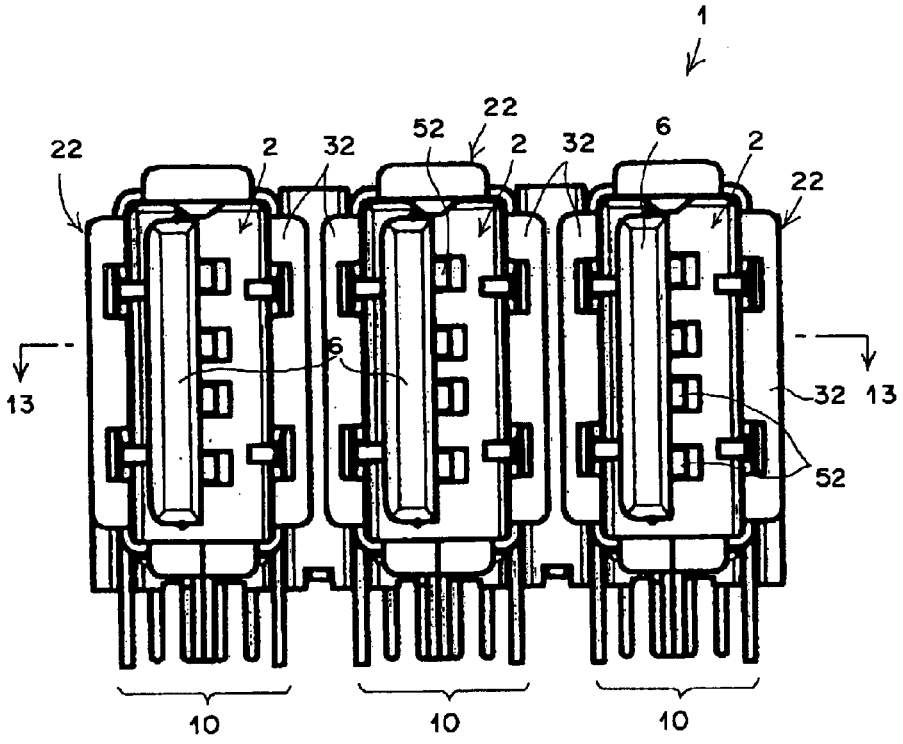
FIG. 10 is a front view of an exemplary shielded connector assembly formed in accordance with an embodiment of the present invention.

Further, as shown most clearly in FIG. 4, paths 16 are formed on both sides of each of the shielded connector portions 10. One path 16 is formed on each side of each partition wall 12. The paths 16 extend vertically between the partition walls 12 and the housing 2 in a direction parallel to the engagement ribs 6. The paths 16 receive the shield shells 22. In other words, each of the shield connector portions 10 and the partition walls 12 are linked by three vertically spaced link portions 11, and the spaces between the link portions 11 are the paths 16.

In an exemplary embodiment, the width of the paths 16 is only slightly larger than the thickness of the shield shells 22 in order that the shield shells 22, once inserted into the paths 16, do not move horizontally between the partition walls 12 and the housing 2. Engagement recesses 18 having rearward facing shoulders 18*a* are formed on the base portion 4 adjacent to the paths 16. Latch tongue pieces 42 and 44 (shown in FIG. 7) of the shield shells 22 are mounted into the engagement recesses 18, as described further below. As used herein, "rearward" refers to a direction opposite the direction toward the other connector (indicated by arrow 7 in FIG. 1) that the shielded connector assembly 1 is to be engaged with.

FIGS. 5 through 9 illustrate exemplary shield shells 22 which are mounted on each shielded connector portion 10 (shown in FIGS. 1–4). In an exemplary embodiment, the shield shell 22 is an integral member formed by punching out and bending a single metal plate to form a rectangular opening 23 (shown in FIG. 9). The shield shell 22 is structured to house the shielded connector portion 10 of housing 2 (shown in FIGS. 1–4) within the opening 23. The shield shell 22 is constructed of an upper wall 24, opposite side walls 26, and a bottom wall 28. Outwardly facing flanges 30, 32, and 34, are formed on each of the walls 24, 26, and 28, respectively.

Rearward facing grounding tongue pieces 38 are formed by cutting and bending the upper wall 24 and the side walls 26 within openings 36. Forward facing latch tongue pieces 40, 42, and 44 engage the housing 2 and are formed in the rear portions of the upper wall 24 and the side walls 26, respectively. A retention leg 46 (securing leg) extends downward from the side wall 26. A mounting leg 48 (securing leg) extends downward from the other side wall 26. A mounting leg 50 is provided on the bottom wall 28 and is constructed by bending the bottom wall 28 at its central portion from both sides so that the two sides are flush with each other. The retention leg 46 and the mounting legs 48 and 50 are mounted to a circuit board (not shown) and soldered thereto. The mounting leg 50 is structured as a single member by a belt portion 50*a* extending from the rear of one of the two plates being wrapped around the other plate so that the two plates do not separate from each other.

FIG. 10 through FIG. 13 illustrate the state in which a shielded connector assembly 1 is constructed by mounting the shield shells 22 on each of the shielded connector portions 10 of the housing 2. When the shield shells 22 are mounted onto the shielded connector portions 10 (shown in FIGS. 1–4), the flanges 32 of adjacent shield shells 22 are arranged so that they too become adjacent. The engagement ribs 6 of housing 2 having the contacts 52 (shown in FIG. 13) arranged therein are exposed within the openings 23 (shown in FIGS. 5 and 9) of the shield shells 22. The flanges 30, 32, and 34 make up the engagement surfaces of the shielded connector portions 10.

Figure 11:
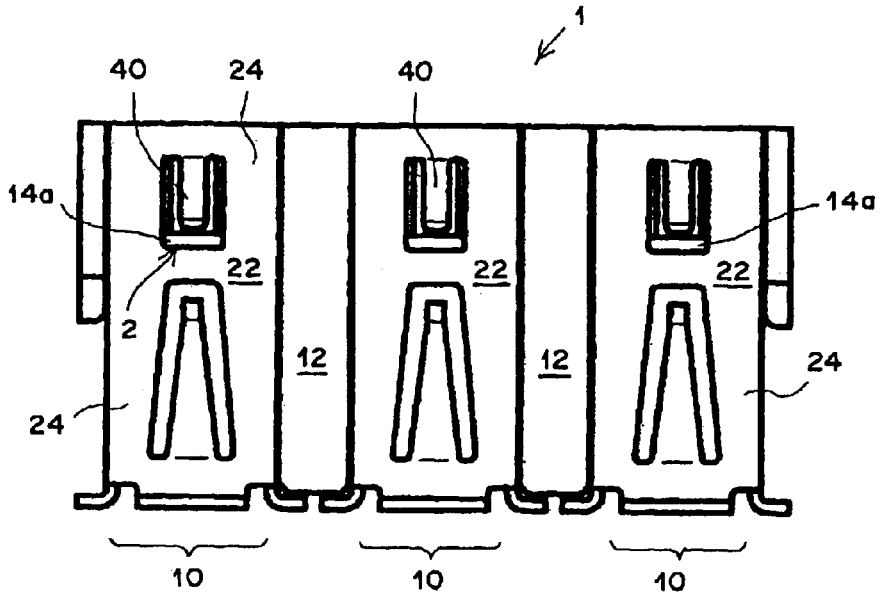
FIG. 11 is a plan view of the shielded connector assembly of FIG. 10.
Figure 12:
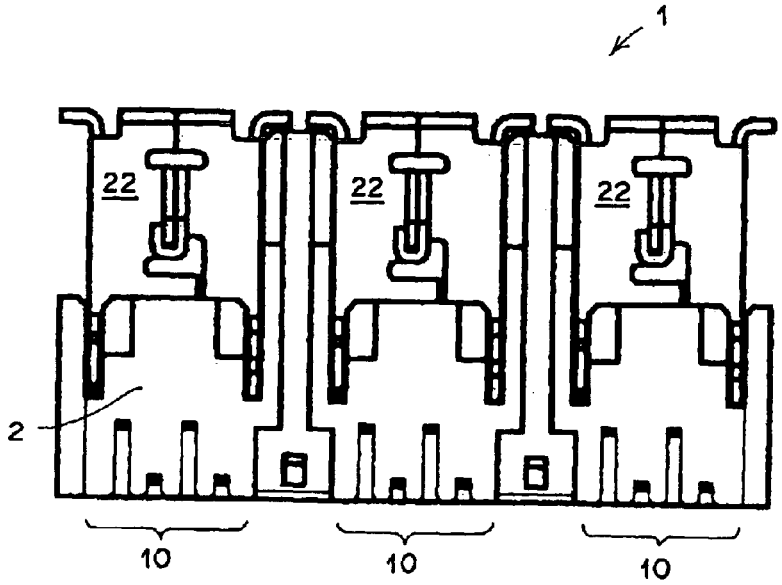
FIG. 12 is a bottom view of the shielded connector assembly of FIG. 10.

As most clearly shown in FIG. 11, the shield shells 22 are prevented from moving forward of the housing 2 by the latch tongue pieces 40 in the upper walls 22 thereof abutting the stopper members 14*a* of the housing 2. In addition, as most clearly shown in FIG. 13, when the side walls 26 of the shield shells 22 enter the paths 16 of the housing 2, the latch tongue pieces 42 engage the shoulders 18*a* of the engagement recesses 18 and are locked thereby. The latch tongue pieces 44 are locked in a similar manner. In this manner, the shield shells 22 are prevented from being pulled out toward the front of the housing 2.

Figure 13:
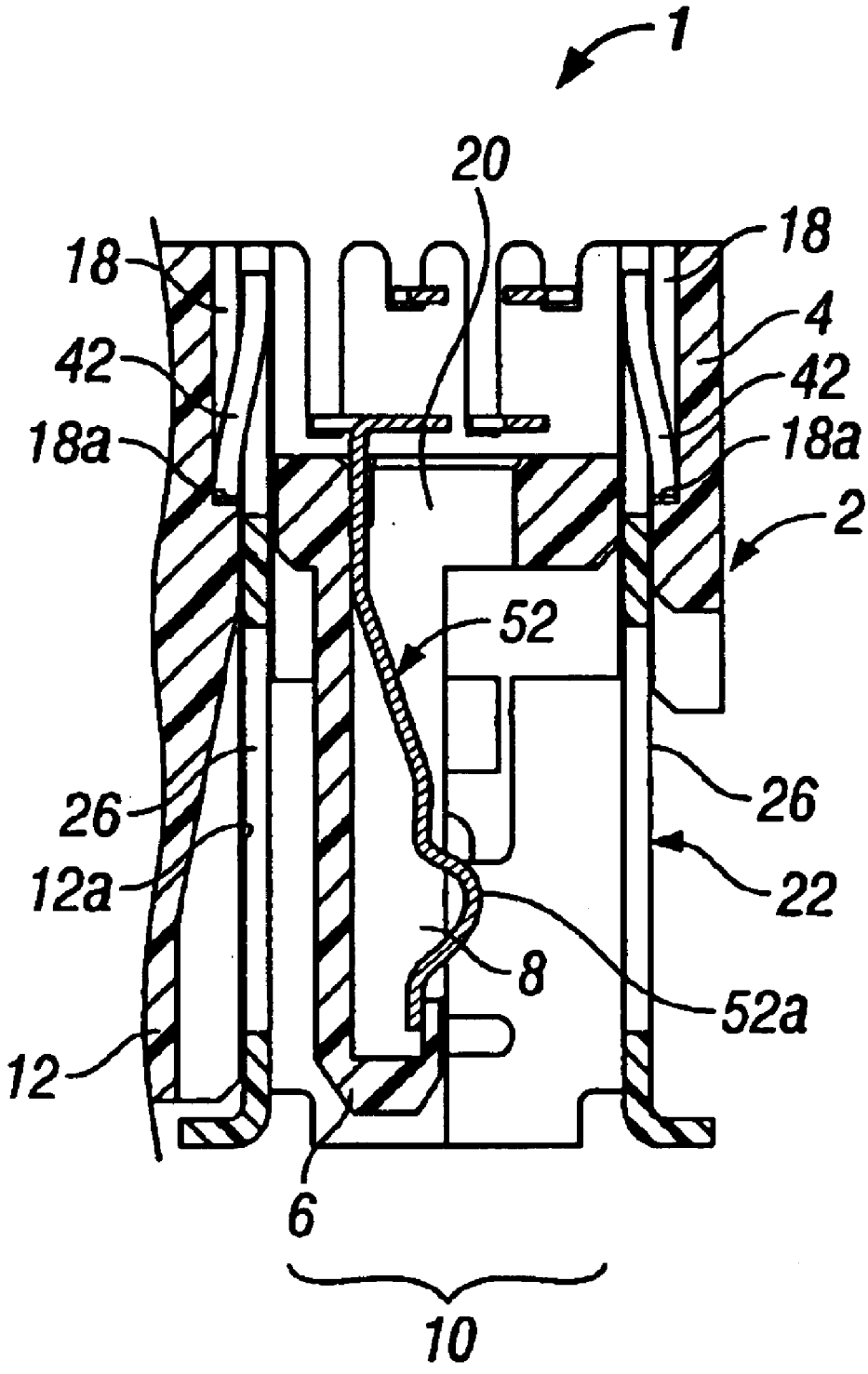
FIG. 13 is a partial sectional view of the shielded connector assembly of FIG. 10 showing the mounted state of the shield shell, taken along the line 13—13 of FIG. 10.

In addition, the shield shells 22 are prevented from being pulled out toward the rear of the housing 2 by the recesses 43 and 45 (FIG. 7, FIG. 8), which abut the link portions 11 (shown in FIG. 2) provided between the shielded connector portions 10. The side walls 26 of the shield shells 22, as shown in FIG. 13, are supported between support surfaces 12*a* of the partition walls 12 and the base portion 4 of the housing 2 so that the shield shells 22 are prevented from moving horizontally (e.g., in the direction perpendicular to the partition walls 12). The shield shell 22 of the central shielded connector portion 10 is supported on both sides by the partition walls 12, so that it is of an extremely strong structure against prying forces. In addition, the shield shells 22 positioned on both ends also exhibit strong resistance against prying forces in the direction towards the partition walls 12. Note that FIG. 13 clearly shows the contacts 52 arranged in the contact housing groove 8. The contacts 52 are inserted into the contact housing grooves 8 from the rear of the housing 2 through the openings 20. Contact portions 52*a* of the contacts 52 protrude from the surface of the engagement ribs 6 to engage the contacts of the other connector (not shown).

While the invention has been described in terms of various specific embodiments, those skilled in the art will recognize that the invention can be practiced with modification within the spirit and scope of the claims.

What is claimed is:

1. A shielded connector assembly comprising:

an insulative housing comprising a plurality of shielded connector portions spaced from one another at predetermined intervals;

a plurality of shield shells for covering the shielded connector portions independently of each other; and contacts arranged at the shielded connector portions, and the insulative housing having wall portions positioned between adjacent shield shells for supporting the shield shells on both sides thereof;

wherein each of the shield shells have securing legs configured to secure the shielded connector assembly to a circuit board on which it is mounted, and wherein said one of the securing legs is provided on a bottom wall of the respective shield shell near a front opening of said shield shell, said one of the securing legs including first and second portions of said bottom wall bent to face one another.

2. A shielded connector assembly in accordance with claim 1 wherein said shield shells include opposite side walls, each of said opposite side walls comprising a latch tongue extending outwardly therefrom.

3. A shielded connector assembly in accordance with claim 1 wherein said shield shells include opposite side walls, each of said opposite side walls comprising a pair of latch tongues extending outwardly therefrom.

4. A shielded connector assembly in accordance with claim 1 wherein said housing further comprises a plurality of partition walls separating adjacent connector portions, said shield shells including opposite side walls, said opposite side walls of at least one of said shield shells supported on said partition walls.

5. A shielded connector assembly in accordance with claim 1 wherein said housing comprises link portions connection adjacent connector portions, each of said shield shells comprising a side wall including a recess therein, said connector portions of said housing abutting said recesses of said side walls when said shield shells are coupled to said housing.

6. A shielded connector assembly in accordance with claim 1 wherein said shield shells each comprise opposite side walls, a bottom wall and an upper wall, said upper wall including an outwardly extending flange, said bottom wall including an outwardly extending flange, said opposite sides extending between said upper wall and said bottom wall and including an outwardly extended flange.

7. A shielded connector assembly in accordance with claim 1 wherein said shield shells comprise an upper wall and a pair of side walls extending therefrom, a forward end of said upper wall comprising an inwardly extending latch tongue.

8. A shielded connector assembly comprising:

an integrally formed insulative housing comprising a plurality of shielded connector portions spaced from one another at predetermined intervals and divided by partition walls;

a plurality of shield shells, each of said shield shells covering a respective one of said shielded connector portions, at least one of said shield shells supported on opposite sides by said partition walls and latched to said partition side walls; and contacts arranged at the shielded connector portions and located within said shield shells;

wherein each of the shield shells have securing legs for securing the shielded connector assembly to a circuit board on which it is mounted, and wherein said one of the securing legs is provided on a bottom wall of the respective shield shell near a front opening of said shield shell, said one of the securing legs including first and second portions of said bottom wall bent to face one another.

9. A shielded connector assembly in accordance with claim 8 wherein said shield shells include opposite side walls and an upper wall extending therebetween, at least one of said opposite side walls and said upper wall comprising a latch tongue extending outwardly therefrom, the other of said at least one of said opposite side walls and said upper wall comprising a latch tongue extending inwardly therefrom.

10. A shielded connector assembly in accordance with claim 8 wherein said shield shells include opposite side walls, each of said opposite side walls comprising a pair of latch tongues extending outwardly therefrom.

11. A shielded connector assembly in accordance with claim 8 wherein said housing further comprises a plurality of contact engaging ribs extending substantially parallel to said partition walls, said ribs including grooves for accepting said contacts, and shield shell paths extending between said ribs and said partition walls.

12. A shielded connector assembly in accordance with claim 8 wherein said housing comprises link portions connection adjacent connector portions, each of said shield shells comprising a side wall including a recess therein, said connector portions of said housing abutting said recesses of said side walls when said shield shells are coupled to said housing.

13. A shielded connector assembly in accordance with claim 8 wherein said shield shells each comprise an upper wall including an outwardly extending flange, a bottom wall including an outwardly extending flange, and opposite sides extending between said upper wall and said bottom wall and including an outwardly extended flange.

14. A shielded connector assembly comprising:

an insulative housing comprising a plurality of shielded connector portions spaced from one another at predetermined intervals and divided by partition walls;

a plurality of shield shells, each of said shield shells covering a respective one of said shielded connector portions, at least one of said shield shells supported on opposite sides by said partition walls and latched to said partition side walls along at least one side wall and an upper wall, each of the shield shells comprising securing legs for securing the shielded connector assembly to a circuit board on which it is mounted, wherein said one of said securing less is provided on a bottom wall of the respective shield shell near a front opening of said shield shell, said one of the securing legs including first and second portions of said bottom wall bent to face one another; and contacts to be arranged at the shielded connector portions and located within said shield shells.

15. A shielded connector assembly in accordance with claim 14 wherein each of said shield shells comprises at least a first side wall a bottom wall, each of said securing legs extending from said side first side wall and said bottom wall.

16. A shielded connector assembly in accordance with claim 8 wherein said shield shells include opposite side walls and an upper wall extending therebetween, at least one of said opposite side walls and said upper wall comprising a latch tongue extending outwardly therefrom, the other of said at least one of said opposite side walls and said upper wall comprising a latch tongue extending inwardly therefrom.

17. A shielded connector assembly in accordance with claim 15 wherein said shield shells include opposite side walls, each of said opposite side walls comprising a pair of latch tongues extending outwardly therefrom.

18. A shielded connector assembly in accordance with claim 15 wherein said housing further comprises a plurality of contact engaging ribs extending substantially parallel to said partition walls, said ribs including grooves for accepting said contacts, and shield shell paths extending between said ribs and said partition walls.

19. A shielded connector assembly in accordance with claim 15 wherein said housing comprises link portions connection adjacent connector portions, each of said shield shells comprising a side wall including a recess therein, said connector portions of said housing abutting said recesses of said side walls when said shield shells are coupled to said housing.

20. A shielded connector assembly in accordance with claim 15 wherein said shield shells each comprise an upper wall including an outwardly extending flange, a bottom wall including an outwardly extending flange, and opposite sides extending between said upper wall and said bottom wall and including an outwardly extended flange.

* * * * *